US010763584B2

(12) United States Patent
Kerselaers et al.

(10) Patent No.: US 10,763,584 B2
(45) Date of Patent: Sep. 1, 2020

(54) CONDUCTIVE PLANE ANTENNA

(71) Applicant: NXP B.V., Eindhoven (NL)

(72) Inventors: Anthony Kerselaers, Herselt (BE); Liesbeth Gommé, Anderlecht (BE)

(73) Assignee: NXP B.V., Eindhoven (NL)

( * ) Notice: Subject to any disclaimer, the term of this patent is extended or adjusted under 35 U.S.C. 154(b) by 316 days.

(21) Appl. No.: 15/873,050

(22) Filed: Jan. 17, 2018

(65) Prior Publication Data

US 2019/0221946 A1 Jul. 18, 2019

(51) Int. Cl.

| | |
|---|---|
| ***H01Q 5/35*** | (2015.01) |
| ***H01Q 1/38*** | (2006.01) |
| ***H01Q 1/22*** | (2006.01) |
| ***H01Q 1/27*** | (2006.01) |
| ***H01Q 13/10*** | (2006.01) |

(52) U.S. Cl.
CPC ..... *H01Q 5/35* (2015.01); *H01Q 1/2291* (2013.01); *H01Q 1/273* (2013.01); *H01Q 1/38* (2013.01); *H01Q 13/10* (2013.01)

(58) Field of Classification Search
CPC ..... H01Q 1/2291; H01Q 1/273; H01Q 1/276; H01Q 1/38; H01Q 5/35; H01Q 5/45; H01Q 13/10; H01Q 13/106; H01Q 13/18; H01Q 21/24
See application file for complete search history.

(56) References Cited

U.S. PATENT DOCUMENTS

| | | | | |
|---|---|---|---|---|
| 5,175,561 | A | 12/1992 | Goto | |
| 5,216,430 | A * | 6/1993 | Rahm | H01Q 9/0435 343/700 MS |
| 6,646,618 | B2 | 11/2003 | Sievenpiper | |
| 8,223,081 | B2 | 7/2012 | Tu | |
| 8,319,688 | B2 | 11/2012 | Parche | |
| 8,912,966 | B2 | 12/2014 | Kerselaers | |

(Continued)

FOREIGN PATENT DOCUMENTS

EP 1906487 A1 4/2008

OTHER PUBLICATIONS

"Vivaldi Antennas"; retrieved from the Internet http://www.antenna-theory.com/antennas/aperture/vivaldi.php; 10 pages; (Jan. 15, 2018).

(Continued)

*Primary Examiner* — Robert Karacsony

(57) ABSTRACT

Example discloses a conductive plane antenna, including, a non-conductive substrate; a conductive plane coupled to the non-conductive substrate; wherein the conductive plane includes an open cavity over the non-conductive substrate; wherein the cavity includes a closed end and an open end; a first feed point coupled to the conductive plane and configured to pass a first polarity of a set of electromagnetic signals; and a second feed point coupled to the conductive plane and configured to pass a second polarity of the set of electromagnetic signals wherein the conductive plane is configured to generate a first antenna gain pattern in response to the first and second polarity signals; wherein the cavity is configured to generate a second antenna gain pattern in response to the first and second polarity signals; and wherein a magnitude of the first antenna gain pattern is greater than a magnitude of the second antenna gain pattern.

20 Claims, 11 Drawing Sheets

(56) References Cited

U.S. PATENT DOCUMENTS

| | | | |
|---|---|---|---|
| 2010/0207829 | A1 | 8/2010 | Parsche |
| 2012/0120772 | A1 | 5/2012 | Fujisawa |

OTHER PUBLICATIONS

Pozar, D. M. et al; "Improved coupling for aperture coupled microstrip antennas"; Electronics Letters, vol. 27, Issue 13; pp. 1129-1132 (1991).
Sharma, Satish Kumar et al; "Investigation of wide-band microstrip slot antenna"; IEEE Transactions on Antennas and Propagation, vol. 52, Issue 3; pp. 865-872 (Apr. 19, 2004).
Wikipedia; "Slot Antenna"; retreived from the Internet https://en.wikipedia.org/wiki/Slot_antenna; 2 pages (Jan. 15, 2018).

* cited by examiner

CONDUCTIVE PLANE ANTENNA

The present specification relates to systems, methods, apparatuses, devices, articles of manufacture and instructions for antenna radiation.

SUMMARY

According to an example embodiment, a conductive plane antenna, comprising: a non-conductive substrate; a conductive plane coupled to the non-conductive substrate; wherein the conductive plane includes an open cavity over the non-conductive substrate; wherein the cavity includes a closed end and an open end; a first feed point coupled to the conductive plane and configured to pass a first polarity of a set of electromagnetic signals; and a second feed point coupled to the conductive plane and configured to pass a second polarity of the set of electromagnetic signals; wherein the conductive plane is configured to generate a first antenna gain pattern in response to the first and second polarity signals; wherein the cavity is configured to generate a second antenna gain pattern in response to the first and second polarity signals; and wherein a magnitude of the first antenna gain pattern is greater than a magnitude of the second antenna gain pattern.

In another example embodiment, the cavity further includes a first edge and a second edge; and the cavity is positioned within the conductive plane such that a first current distribution on the first edge of the cavity is opposite to a second current distribution on the second edge of the cavity.

In another example embodiment, a polarity of the first current distribution at the first edge is opposite to a polarity of the second current distribution on the second edge of the cavity.

In another example embodiment, a magnitude of the first current distribution at the first edge is substantially equal to a magnitude of the second current distribution on the second edge of the cavity.

In another example embodiment, the cavity further includes a first edge and a second edge; and the cavity is positioned within the conductive plane such that a first current distribution on the first edge of the cavity substantially cancels out a second current distribution on the second edge of the cavity.

In another example embodiment, the first and second feed points are located closer to the closed end of the cavity than the open end.

In another example embodiment, the conductive plane is connected to at least one of: a ground potential, a power supply potential, or an intermediate circuit potential.

In another example embodiment, the conductive plane includes an outer edge having a physical or electrical length of at least one-half wavelength of a lowest in-band frequency in the set of electromagnetic signals.

In another example embodiment, the open cavity includes a depth having a physical or electrical length at least one-quarter wavelength of a lowest in-band frequency in the set of electromagnetic signals.

In another example embodiment, excluding the open cavity, the conductive plane includes an outer edge which is continuously curved.

In another example embodiment, the conductive plane includes an outer edge; and wherein the outer edge is defined by an envelope that is either circular or oval in shape.

In another example embodiment, the closed end of the open cavity is located proximate to a geometrical center of the conductive plane.

In another example embodiment, further comprising a conducting reflector on one side of the conductive plane.

In another example embodiment, the conducting reflector is a loudspeaker.

In another example embodiment, the reflector includes a non-conductive cavity aligned with the open cavity in the conductive plane.

In another example embodiment, further comprising a second conductive plane;

wherein the first conductive plane is coupled to the second conductive plane with vias.

In another example embodiment, further comprising a set of electrical circuits or components on a same side of the substrate as the conductive plane; and wherein the conductive plane surrounds the electrical circuits or components.

According to an example embodiment, a wearable device, comprising: a conductive plane antenna, including: a non-conductive substrate; a conductive plane coupled to the non-conductive substrate; wherein the conductive plane includes an open cavity over the non-conductive substrate; wherein the cavity includes a closed end and an open end; a first feed point coupled to the conductive plane and configured to pass a first polarity of a set of electromagnetic signals; and a second feed point coupled to the conductive plane and configured to pass a second polarity of the set of electromagnetic signals; wherein the conductive plane is configured to generate a first antenna gain pattern in response to the first and second polarity signals; wherein the cavity is configured to generate a second antenna gain pattern in response to the first and second polarity signals; and wherein a magnitude of the first antenna gain pattern is greater than a magnitude of the second antenna gain pattern.

In another example embodiment, the wearable device is at least one of: a wireless gaming headphone, a wireless headset, a smart helmet, or smart/VR goggles.

The above discussion is not intended to represent every example embodiment or every implementation within the scope of the current or future Claim sets. The Figures and Detailed Description that follow also exemplify various example embodiments.

Various example embodiments may be more completely understood in consideration of the following Detailed Description in connection with the accompanying Drawings, in which:

Figure 1:
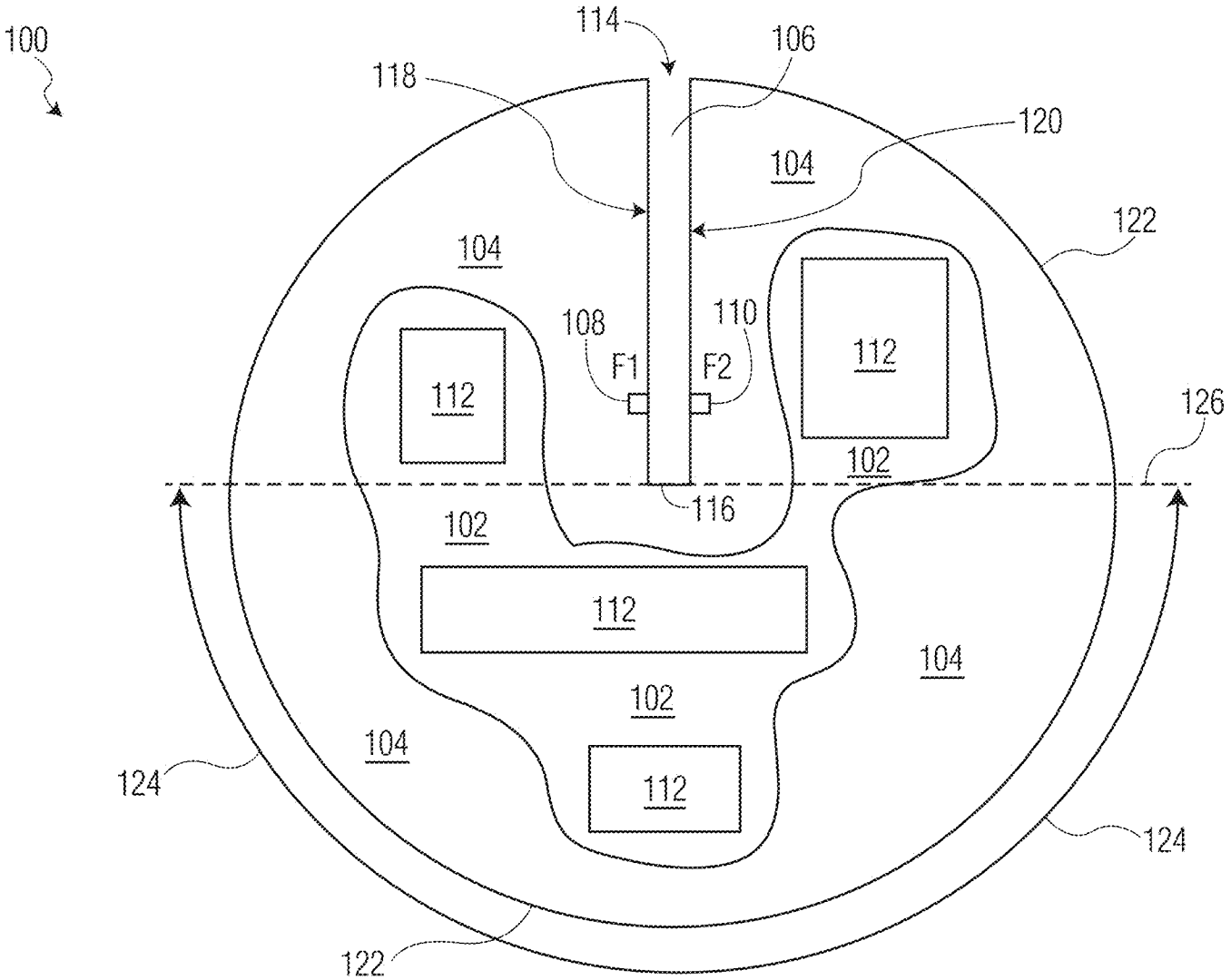
FIG. 1 is a first example conductive plane antenna.

While the disclosure is amenable to various modifications and alternative forms, specifics thereof have been shown by way of example in the drawings and will be described in detail. It should be understood, however, that other embodiments, beyond the particular embodiments described, are possible as well. All modifications, equivalents, and alternative embodiments falling within the spirit and scope of the appended claims are covered as well.

DETAILED DESCRIPTION

Headphone systems are used as wireless communication devices and high quality audio playback devices. High quality audio must be understood like CD like quality sound with larger audio bandwidth than voice audio.

A basic headphone comprises a wireless communication system, speaker and associated electronics. Some also may have one or more microphones. When a communication must be established across a larger range, like more than 1 meter, often solutions use a radio module that works with electromagnetic (EM) waves.

Electromagnetic waves can propagate over large distances and their power rolls off as the inverse of the square of the distance from the source. For example, Bluetooth or Bluetooth low energy (BLE) devices operate in the 2.5 GHz frequency band and have an operating range to 30 meters.

Such headphones are used for example in hands-free cellular operation or gaming where there is communication with a dongle attached to the gaming computer or network. Wireless antenna communications for such use-cases are designed for robustness.

One important parameter for a wireless antenna is a frequency range in which the antenna can be used with sufficient efficiency (i.e. the antenna's bandwidth). For example, the bandwidth required to operate in the world wide 2.4 GHz ISM band is 83 MHz.

One other challenge associated with the robust design of such wireless antennas is achieving a desired input impedance for reasonably matching the antenna to a front end RF integrated transceiver circuit. Without a proper impedance matching the available power from the RF integrated circuit is not accepted by the antenna and reflected to the source. This matching quality is characterized over the operating band as return-loss.

Furthermore, integrating such wireless antennas in space constrained headphones present various additional problems. For example a headphone usually has a dedicated design and not much volume left for the wireless antenna. This often results in wireless antenna gain patterns that are not sufficiently omnidirectional.

FIG. 1 is a first example conductive plane antenna 100. The first example conductive plane antenna 100 includes a substrate 102, a conductive plane 104, an open cavity 106 (non-conductive), a first feed point (F1) 108, a second feed point (F2) 110, and electronic components/circuits 112.

The substrate 102 includes a first side (i.e. front side, shown) and a second side (i.e. back side, not shown). The conductive plane 104 an outer edge 122 (circumference), a one-half (½) wavelength edge portion 124, and a dotted line 126 (bisecting the conductive plane 104).

The substrate 102 may be a printed circuit board with conductive areas and electric connections between various electronic components and circuits. The substrate 102 material in one example is an FR4 material but can also be any other non-conductive material.

The open cavity 106 includes an open end 114 and a closed end 116 which together define a depth (i.e. physical distance from open to closed end) of the cavity 106. The cavity 106 also includes a first edge 118 and a second edge 120.

The depth in some example embodiments has a physical or electrical length at least one-quarter (¼) wavelength of a lowest in-band frequency in the set of electromagnetic signals. In some example embodiments, the closed end 116 of the open cavity 106 is located proximate to a geometrical center of the conductive plane 104.

The cavity 106 can be of any shape, however, for discussion purposes a rectangular cavity 106 is shown in the Figures.

The cavity 106 is filled with a non-conductive material or substrate 102 material or a mixture of substrate 102 materials. In some example embodiments, the cavity 106 is filled with air. In other example embodiments, the cavity 106 is first filled with a layer of air and then with a second layer of FR4 material. The first layer of air can have a height of 35 μmeter while the second layer of FR4 material can have a height of 1 millimeter.

The cavity 106 in some examples can have a length of 18 mm on a FR4 printed circuit board of 1 mm thickness, and a width W that influences the operational bandwidth of the antenna (e.g. the width can be 1 mm).

The antenna's 100 polarization can be changed by reorienting the cavity 106 at a different angle (e.g. horizontal, 45 degree, etc. further discussed below). The antenna's 100 reactance can be partially set by the width of the cavity 106.

The first feed point (F1) is connected to the conductive plane 104 at position 108. The first feed point 108 is configured to pass a first polarity of a set of electromagnetic signals.

The second feed point (F2) 110 is connected to the conductive plane 104 at position 110. The second feed point 110 is configured to pass a second polarity of the set of electromagnetic signals. The first feed point (F1) and the second feeding point (F2) are connected to various electronic components/circuits 112.

If the feeding points F1 108 and F2 110 were moved along the edges 118, 120 of the cavity 106, an impedance seen at the feeding points would increase from zero at the closed end 116 to a greater impedance as the feeding points' positions are moved toward the open end 114 of cavity 106. In some example embodiments, the impedance at the feeding port should be 50 Ohms for maximum power transfer between antenna 100 and the electronic components/circuits 112 (e.g. a radio integrated circuit (RF-IC)). For further impedance optimization and frequency filtering, an additional matching network can be used.

The first F1 and second F2 feed points in some example embodiments are located closer to the closed end 116 of the cavity 106 than the open end 114.

The electronic components/circuits 112 in various example embodiment may include an antenna impedance matching circuit, a radio circuit, an audio decoding circuit, an audio amplifier circuit, a controller circuit, a user interface circuit and/or a power supply circuit. The set of electrical circuits or components 112 can be located on a same side or opposite of the substrate 102 as the conductive plane 104.

Once all electronic components are connected to the substrate 102 the remaining area is filled with the conductive plane 104. Shown is an example embodiment where the conductive plane 104 surrounds the electrical circuits or components 112.

The conductive plane 104 is configured to generate a first antenna gain pattern in response to the first and second polarity signals. The cavity 106 is configured to generate a second antenna gain pattern in response to the first and second polarity signals. With the structure discussed, the conductive plane 104 acts as a primary source of radiation (i.e. a magnitude of the first antenna gain pattern from the conductive plane 104 is greater than a magnitude of the second antenna gain pattern from the cavity 106). Thus current density/flow patterns in the conductive plane 104 results in radiation primarily, if not completely, from the conductive plane 104 and not the cavity 106.

The conductive plane 104 is connected to at least one of: a ground potential, a power supply potential, or an intermediate circuit potential.

The conductive plane 104 includes an outer edge 122 having a physical or electrical length of at least one-half (½) wavelength of a lowest in-band frequency in the set of electromagnetic signals.

In some example embodiments, excluding the open cavity 106, the outer edge 122 of the conductive plane 104 is continuously curved, and may be defined by an envelope that is either circular or oval in shape (e.g. a circular diameter of 50 mm). Curve is herein defined to include at least one of: a circular portion, a spherical portion, a conical portion, a parabola portion, or any topological space which is locally homeomorphic to a line. This curve may also be defined as a substantially curved envelope which may include locally sharp edges (e.g. due to the manufacturing process).

To effect radiation primarily from the conductive plane 104, the cavity 106 is positioned within the conductive plane 104 such that a first current distribution on the first edge 118 of the cavity 106 is opposite to a second current distribution on the second edge 120 of the cavity 106. Thus currents on either side of the cavity tend to cancel each other, thereby minimizing radiation from the cavity 106.

Figure 2:
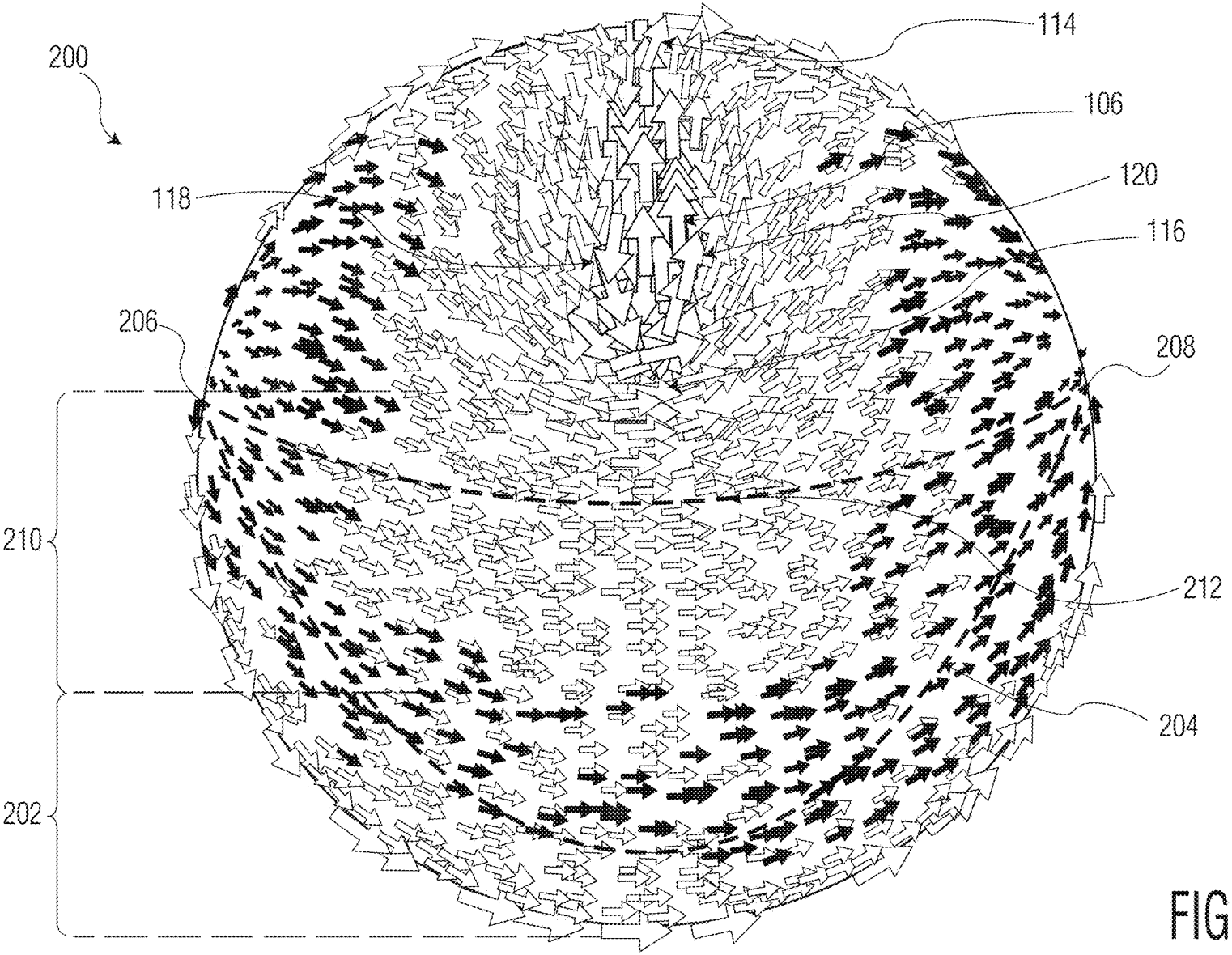
FIG. 2 is an example current density distribution on the conductive plane antenna.

As will be further shown and discussed in FIG. 2, the polarity of the first current distribution at the first edge 118 is opposite to a polarity of the second current distribution on the second edge 120 of the cavity 106. In some example embodiments, the magnitude of the first current distribution at the first edge 118 is substantially equal to the magnitude of the second current distribution on the second edge 120 of the cavity 106.

Thus, the cavity 106 is positioned within the conductive plane 104 such that the first current distribution on the first edge 118 of the cavity 106 substantially cancels out the second current distribution on the second edge 120 of the cavity 106.

In this example, the cavity 106 has a vertical geometric orientation and thereby is resonant with radiated energy having a horizontal polarization.

The dimensions of the conductive plane 104 are related to the wavelengths of electromagnetic signals to be received and/or transmitted. A circular shape has been found beneficial and fits very well in a headphone design form factor.

When an electrical length of a portion 124 of the edge 122 of the conductive plane 104 is a ½ wavelength of the transmit frequency, then the antenna reaches an optimal performance. However, portion 124 (e.g. "S") might deviate somewhat from an ideal electrical length and still be efficient enough for some applications.

Unless otherwise specified, edge is herein defined as an edge of the conductive plane 104 and not the edge of the substrate 102. The dotted line 126 denotes a ½ wavelength electrical length of a higher in-band frequency to be transmitted or received by the conductive plane 104 antenna 100.

A size of the various dimensions of the antenna 100 structures can be scaled to obtain an application specific radiation performance over a wide variety of operating frequencies.

For comparison purposes, for an antenna operating at the world-wide ISM band, the 2.5 GHz carrier frequency wavelength is 12 cm. A prior art dipole antenna would require a total length of a half wavelength, which is 6 cm at 2.5 GHz. A prior art monopole antenna consists of a quarter wave radiator (3 cm) and a conductive plane 104 with a size of at least a half wavelength (6 cm). Such dipole and monopole antennas are quite large and unlikely or difficult to be integrated into an small wearable device. They both require additional height above their conductive planes to be efficient. However, the antenna 100 presented wherein the cavity 106 has a ¼ wavelength electrical/physical length is implemented in a same plane as the conductive plane 104, and thus no extra space is required above the conductive plane 104 and/or the electronic circuits/components or substrate 102.

FIG. 2 is an example current density distribution 200 on the conductive plane antenna 100 with a vertical cavity 106. The example current density distribution 200 shows the conductive plane 104 covered in simulated current vectors (i.e. arrows). The arrow size represents a current magnitude and the arrow direction represents a current polarity.

Also shown is the open cavity 106 including the open end 114, the closed end 116, the first edge 118, and the second edge 120. The feeding points F1 and F2, with feeding positions, 108, 110 are near the closed end 116 of the cavity 106.

Note that the current arrows near the first edge 118, have a first cavity edge current magnitude and polarity that is substantially opposite in polarity but equal in magnitude to a second cavity edge current magnitude and polarity near the second edge 120.

Based on the geometry, the conductive plane 104 hosts a high frequency current path region 202, having longer physical/electrical lengths), and a low frequency current path region 210, having shorter physical/electrical lengths. An example high frequency electrical length 204 between locations 206 and 208 is shown in the high frequency current path region 202, and an example low frequency electrical length 212 between locations 206 and 208 is shown in the low frequency current path region 210.

In this example embodiment, the ½ wavelength edge portion 124 locations 206 and 208 on the outer edge 122 of the conductive plane 104 are perpendicular to the closed end 116 of the cavity 106, thus a half wave resonance is formed between locations 206 and 208.

The current density is at a relative maximum in the ½ wavelength edge portion 124 between locations 206 and 208. The current density is at a relative minimum near locations 206 and 208. Currents are induced throughout the lower half of the conductive plane 104 resulting in the wide bandwidth of frequencies that can be transmitted and/or received.

In some example embodiments, this mode of operation is achieved by locating the closed end 116 of the cavity 106 roughly at the geometric center of conductive plane 104 and minimizing the area of the cavity 106 region.

The cavity 106 itself generates minimal radiation since the first and second edge 118, 120 currents are flowing in opposite directions and thus substantially cancel out.

Currents in the conductive plane 104 that are further from the closed end of the cavity 106 are not canceled out and radiate RF energy from the conductive plane 104 itself.

Moving from the high frequency region 202 to the low frequency region 210, differing physical/electrical lengths radiating enable a wide-band of RF frequencies.

The current vectors responsible for the far field radiation create arcs that follow the circular shape of the conductive plane 104 as shown by the example high frequency electrical length 204 and the example low frequency electrical length 212.

Figure 3A:
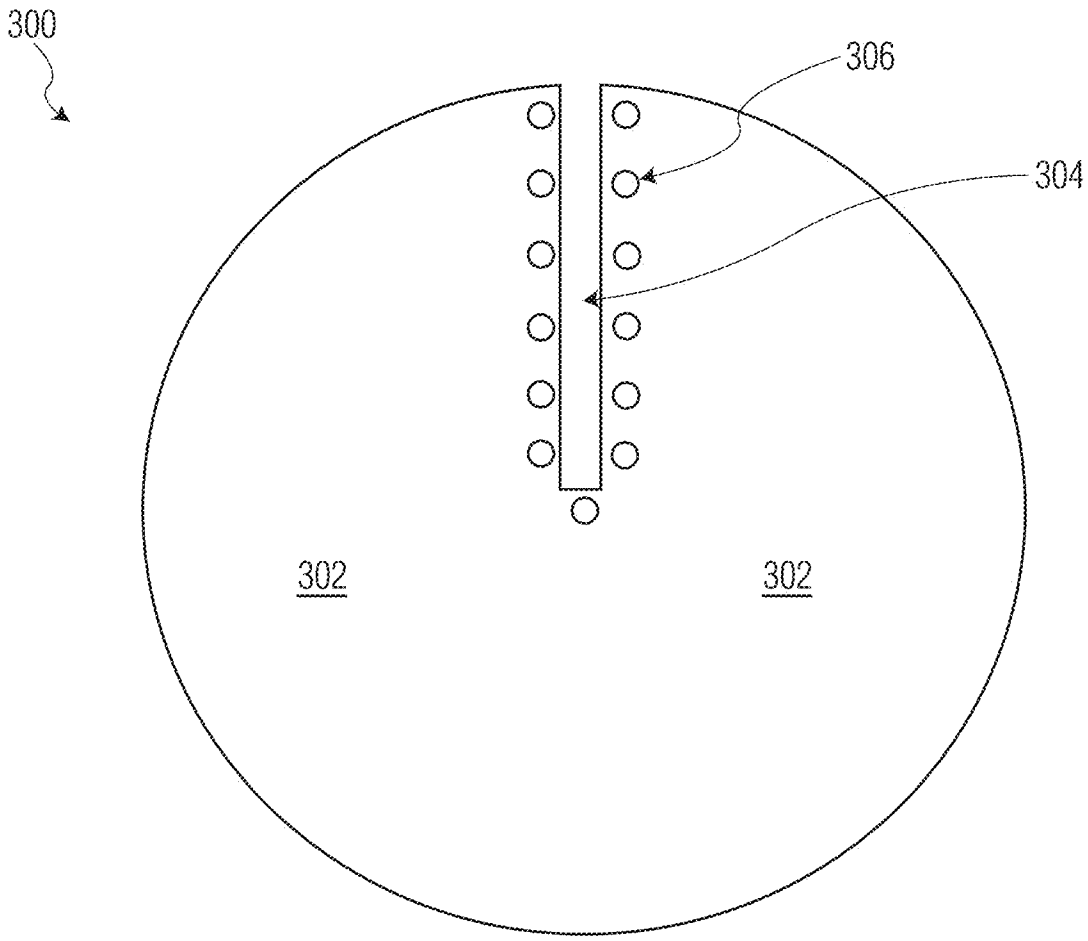
FIG. 3A is a second example conductive plane antenna.

FIG. 3A is a second example conductive plane antenna 300. The second example conductive plane antenna 300 includes a first conductive plane 302, an open cavity 304, and a set of vias 306 (i.e. each of the small circles is a via).

This second antenna 300 in some examples is coupled using the vias 306 to a second conductive plane 303 (not shown) substantially parallel with the first conductive plane 302. Both conductive planes 302, 303 have similar cavities that are substantially aligned (e.g. you can "look through it"). Thus in some example embodiments, there are two stacked conductive planes 302, 303 separated by the substrate 102.

In some example embodiments, a distance between the vias are less than $1/10^{th}$ of the wavelength of the electromagnetic signals to be transmitted and/or received by the antenna 300 so as not to substantially attenuate antenna gain within the operating bandwidth.

If a more complex conductive plane stack-up is used, for example 4 or 6 layer printed circuit board, one of the layers may be the conductive plane 302.

Figure 3C:
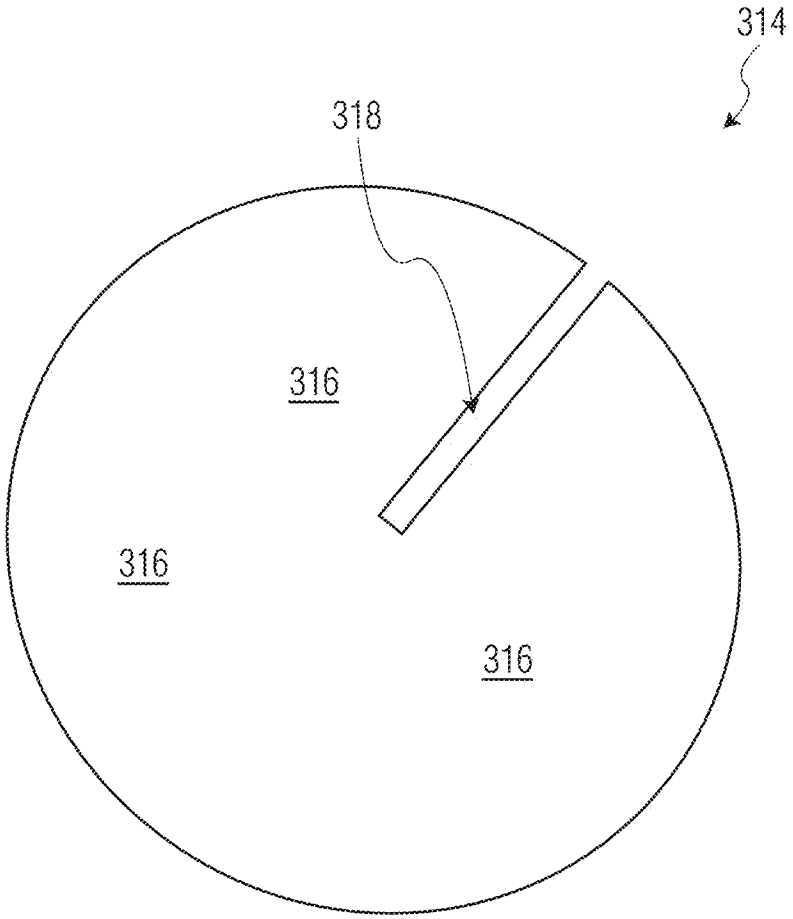
FIG. 3C is a fourth example conductive plane antenna.
Figure 3B:
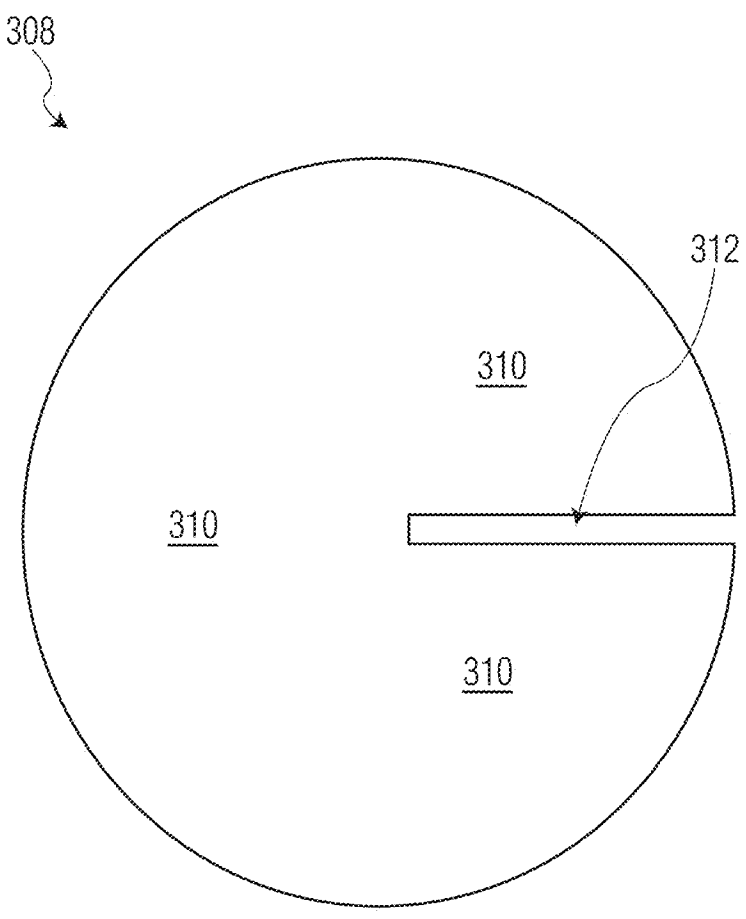
FIG. 3B is a third example conductive plane antenna.

FIG. 3B is a third example conductive plane antenna 308. The third example conductive plane antenna 308 includes a conductive plane 310 and an open cavity 312. Because the cavity 312 has a horizontal orientation, the antenna 308 resonates with vertically polarized electromagnetic signals. This is because the current direction in the conductive plane 310 that is responsible for the far field radiation is mainly perpendicular to the cavity 312 direction.

FIG. 3C is a fourth example conductive plane antenna 314. The fourth example conductive plane antenna 314 includes a conductive plane 316 and an open cavity 318. The 45 degree orientation of the cavity 318 results in electromagnetic signal resonance in both horizontal and vertical polarizations.

Figure 4:
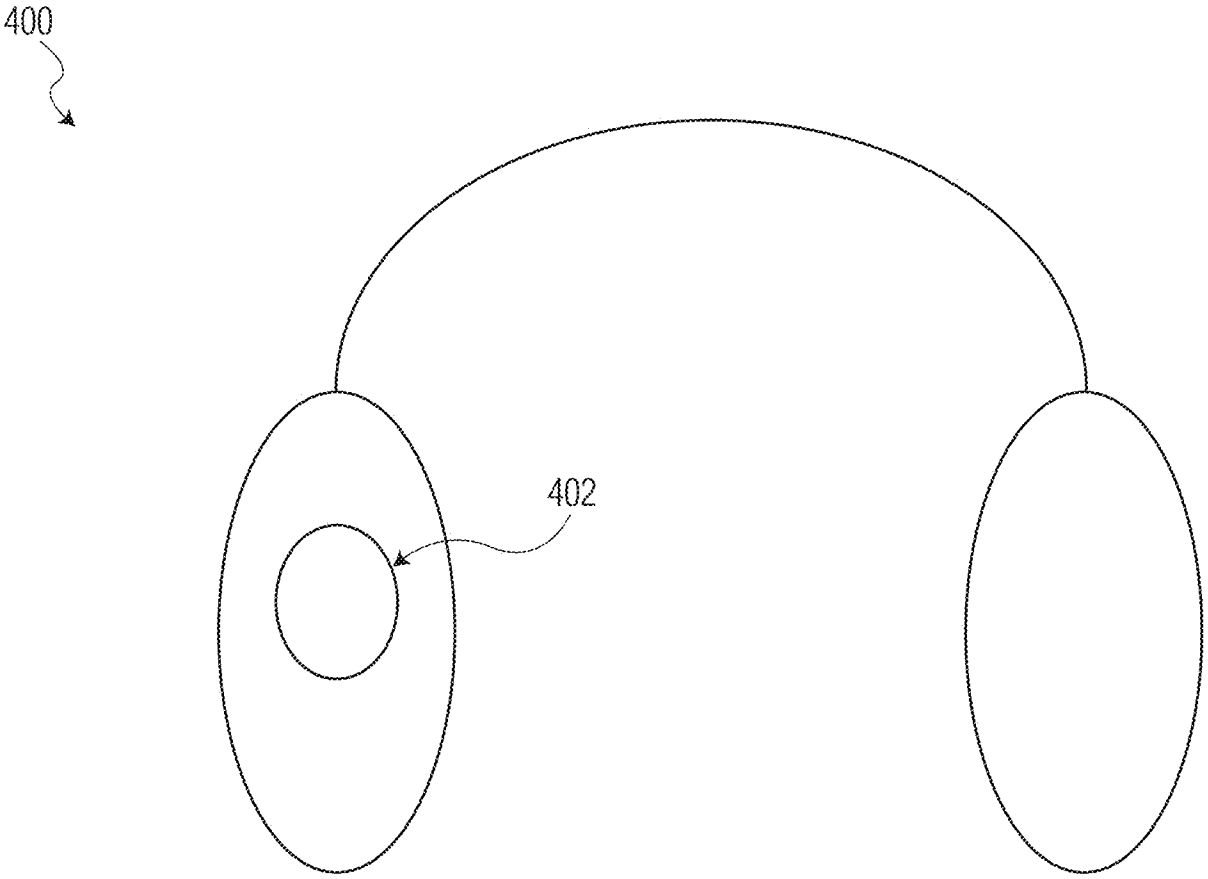
FIG. 4 is an example wearable device including a conductive plane antenna.

FIG. 4 is an example wearable device 400 including a conductive plane antenna 402. The example wearable device 400 includes a conductive plane antenna 402, such as those examples discussed above. More than one conductive plane may be included in the wearable device 400.

In various example embodiments, the wearable device 400 can be either a wireless headphone (e.g. a gaming headphone), a headset, a smart helmet, or smart/VR goggles.

In these examples, the conductive plane 402 is mounted in parallel with a user's ear. A user wearing the wearable device 400 further shapes the antenna gain pattern.

Figure 5:
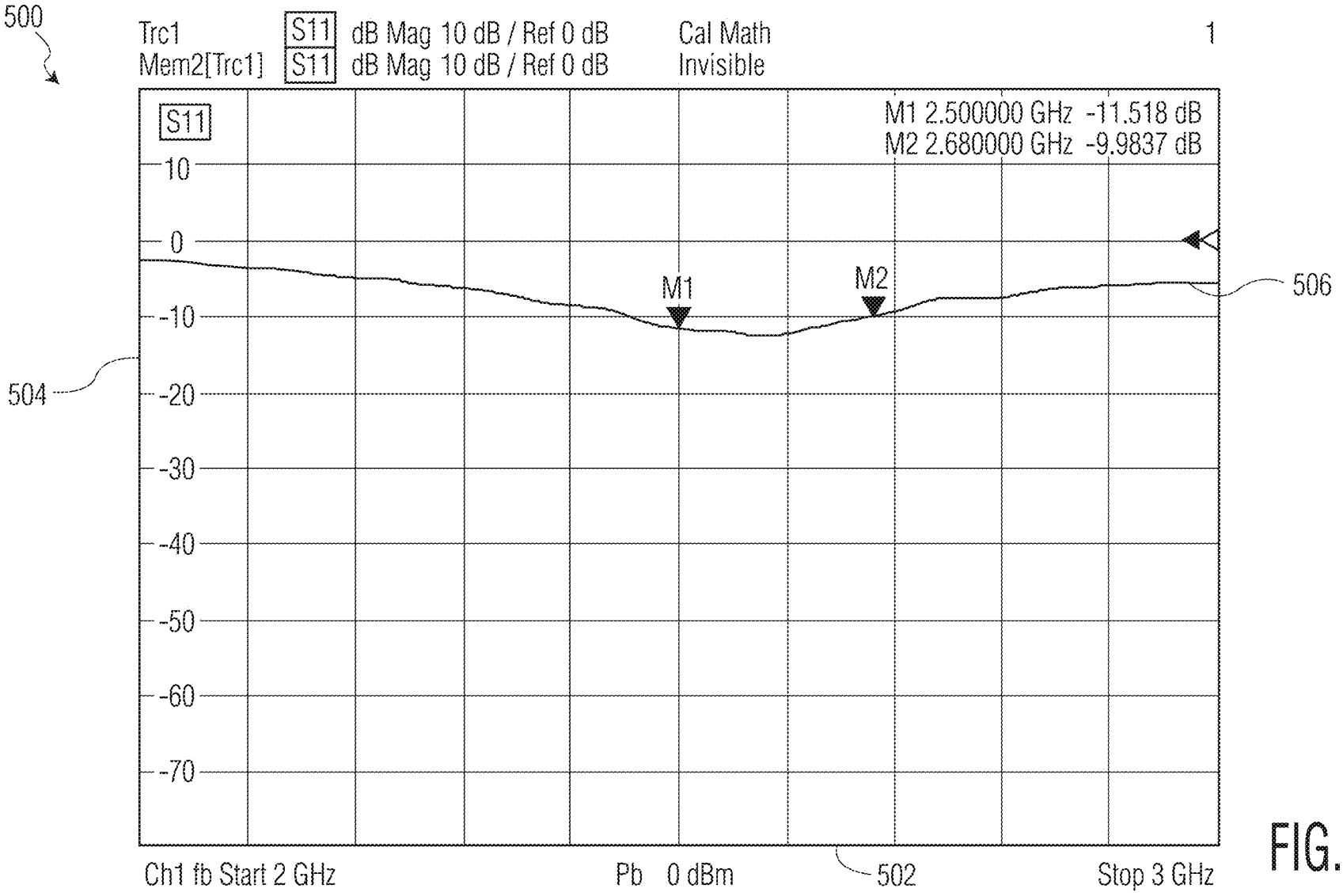
FIG. 5 is an example measured frequency vs. return-loss diagram of the conductive plane antenna of FIG. 4.

FIG. 5 is an example frequency vs. return-loss diagram of the conductive plane antenna of FIG. 4. The example frequency vs. return-loss diagram 500 includes a frequency axis 502, a return-loss axis 504, and a return-loss 506 plot. The return loss is a measurement that shows an impedance matching performance. The return-loss 506 plot is based on one of the set of example embodiment dimension presented above.

Usually a −10 dB return loss indicates a very good matching situation. As can be seen in the return-loss 506 plot the −10 dB range is more than 180 MHz wide and twice a required bandwidth in the 2.4 GHz BLE band. Two markers (M1 and M2) are at the 2.5 and 2.68 GHz. The BLE (Bluetooth Low Energy) band ranges from 2.4 GHz to 2.4835 GHz and 83 MHz wide also benefits from at least −10 dB return loss.

Figure 6:
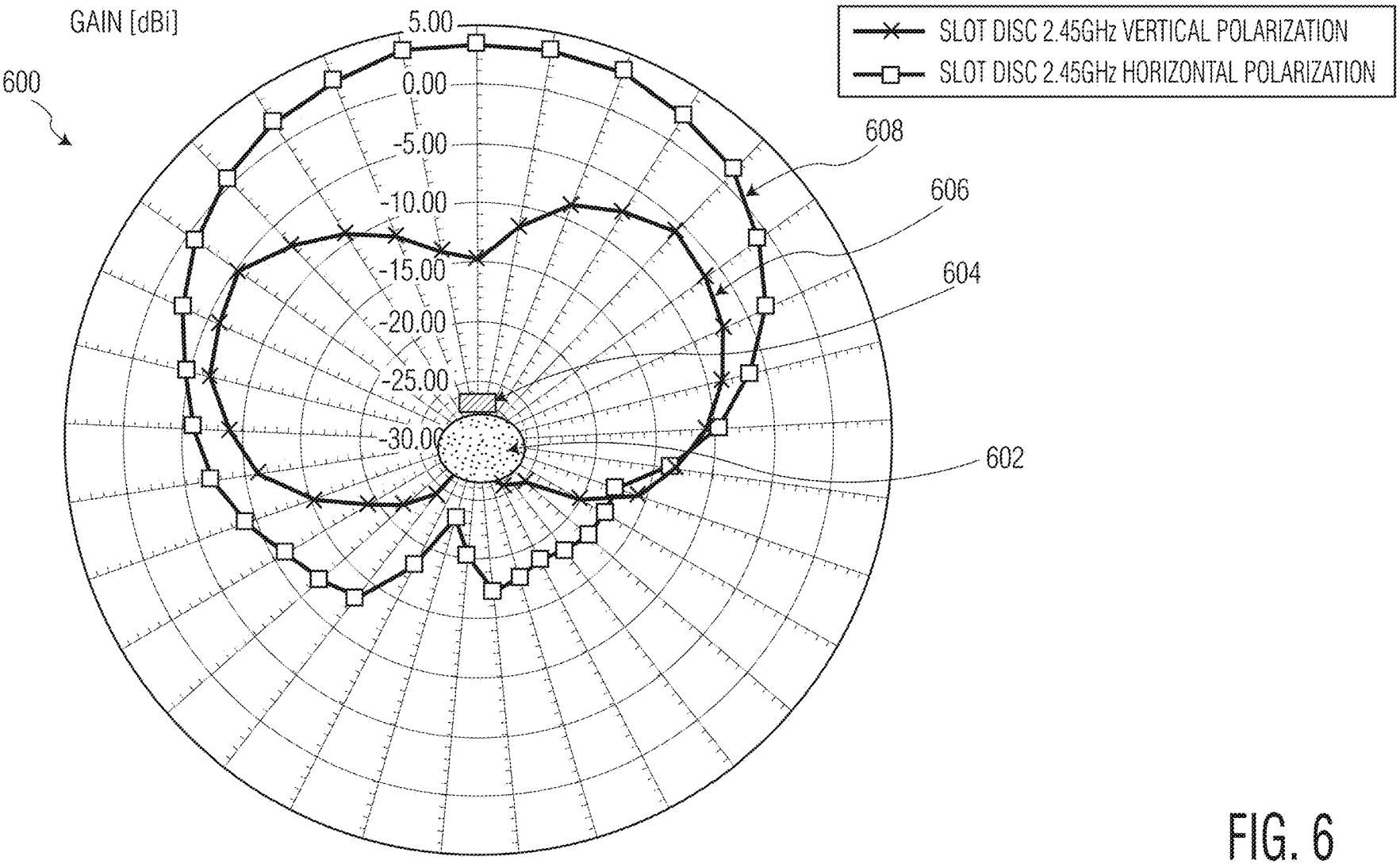
FIG. 6 is an example measured radiation pattern for the first example conductive plane antenna having a vertically oriented open cavity of FIG. 1.

FIG. 6 is an example measured radiation pattern 600 for first example conductive plane antenna 100 having a vertically oriented open cavity 106 of FIG. 1. The measured radiation pattern 600 in the horizontal plane is shown in a polar coordinate graph format centered about a user 602 wearing a headphone 604 containing the conductive plane antenna 100 of FIG. 1.

A vertical polarization antenna gain 606 plot and a horizontal polarization antenna gain 608 plot are as shown. As can be seen the horizontal polarization antenna gain 608 is dominant and has maximum gain on a side of the user's 602 head where the conductive plane antenna 100 is mounted. There is reduction of gain on the other side of the user's 602 head due to tissue absorption.

Figure 7:
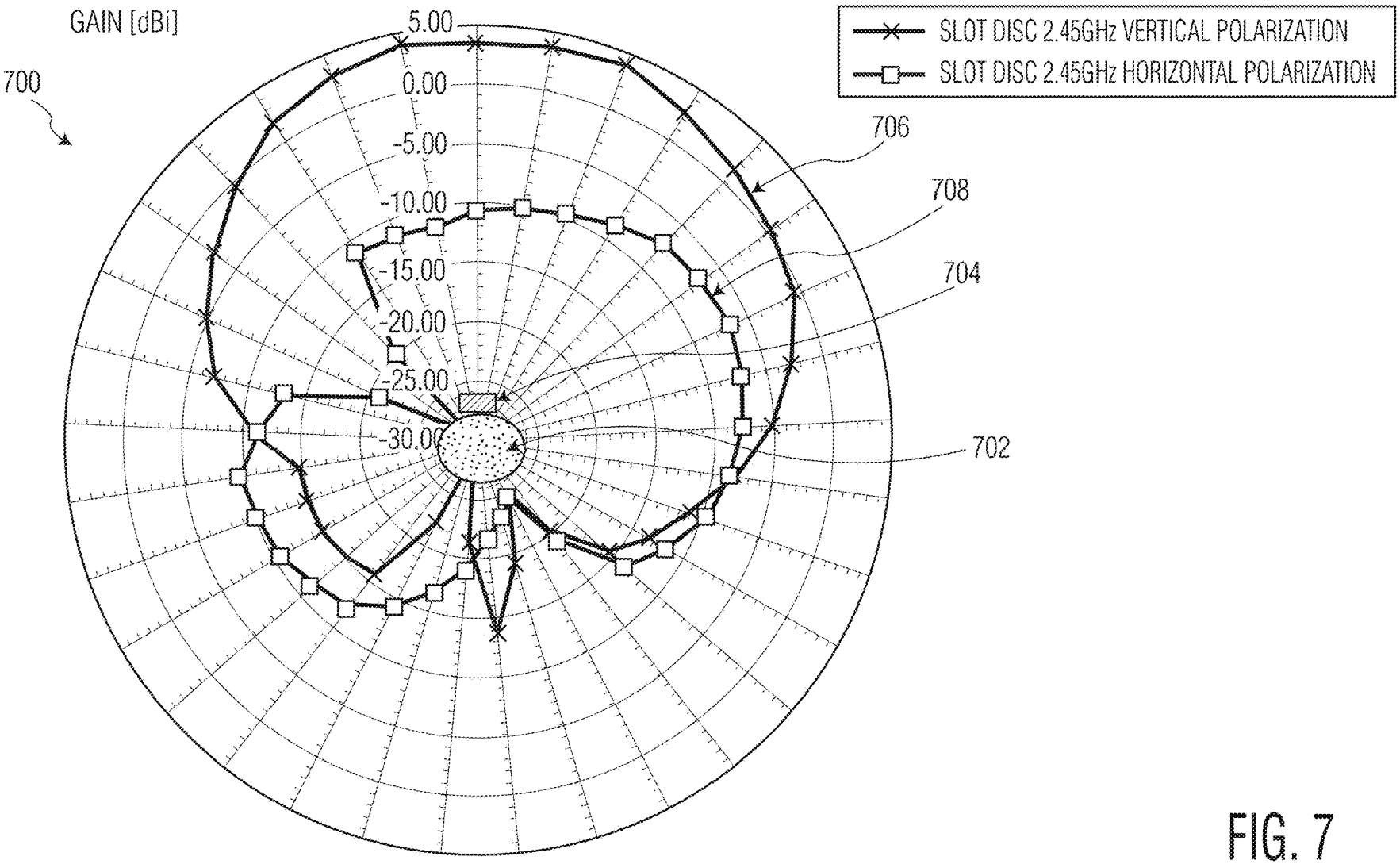
FIG. 7 is an example measured radiation pattern for third example conductive plane antenna having a horizontally oriented open cavity of FIG. 3B.

FIG. 7 is an example measured radiation pattern for third example conductive plane antenna 308 having a horizontally oriented open cavity 312 of FIG. 3B. The measured radiation pattern 700 in the horizontal plane is shown in a polar coordinate graph format centered about a user 702 wearing a headphone 704 containing the antenna 308.

A vertical polarization antenna gain 706 plot and a horizontal polarization antenna gain 708 plot are as shown. As can be seen the vertical polarization antenna gain 706 is dominant and has maximum gain on the side of the user's 702 head where the conductive plane antenna 308 is mounted. There is reduction of gain on the other side of the user's 702 head due to tissue absorption.

Mounting a second antenna with a second conductive plane antenna at the other ear side of the headphone will result in an overall omnidirectional radiation pattern. Different polarizations can also be used to make the communication link more robust in multipath environments.

Figure 8:
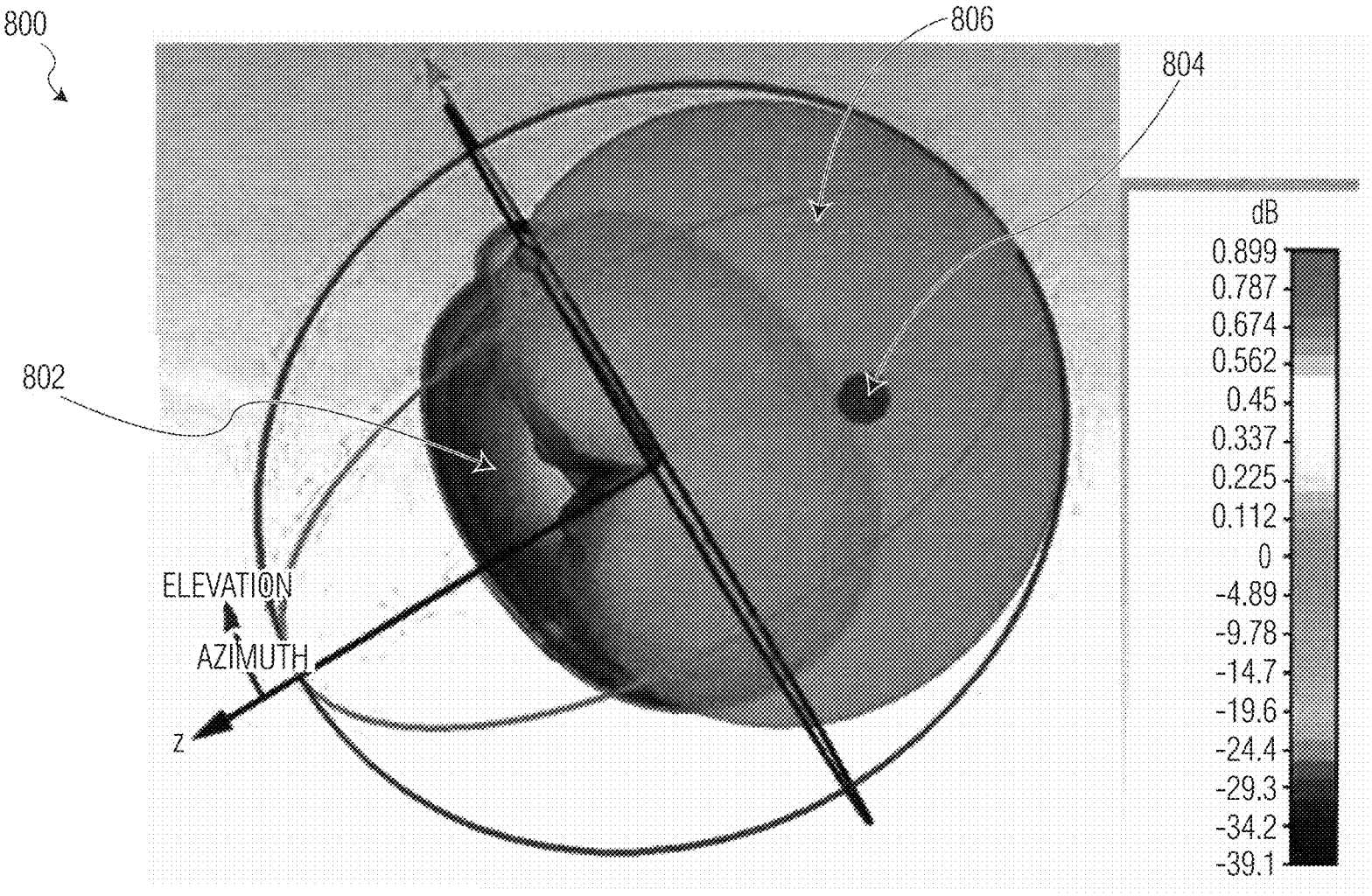
FIG. 8 is an example simulated radiation pattern for fourth example conductive plane antenna having a 45 degree oriented open cavity of FIG. 3C.

FIG. 8 is an example simulated 3 dimensional radiation pattern for fourth example conductive plane antenna 314 having a 45 degree oriented open cavity 318 of FIG. 3C. The simulated radiation pattern 800 is shown in a planar format centered about a user 802 wearing a headphone 804 containing the antenna 314.

An antenna gain 806 for this configuration is also shown. There are no substantial gain attenuations at the side of the user's 802 head were the antenna 314 is mounted. At the other side of the user's 802 head gain is attenuated due to the absorption properties of a human head. For comparison purposes, dipole antennas would result in at least 2 strong directions where antenna gain is reduced (e.g. toroidal antenna gain shape of a dipole).

Figure 9A:
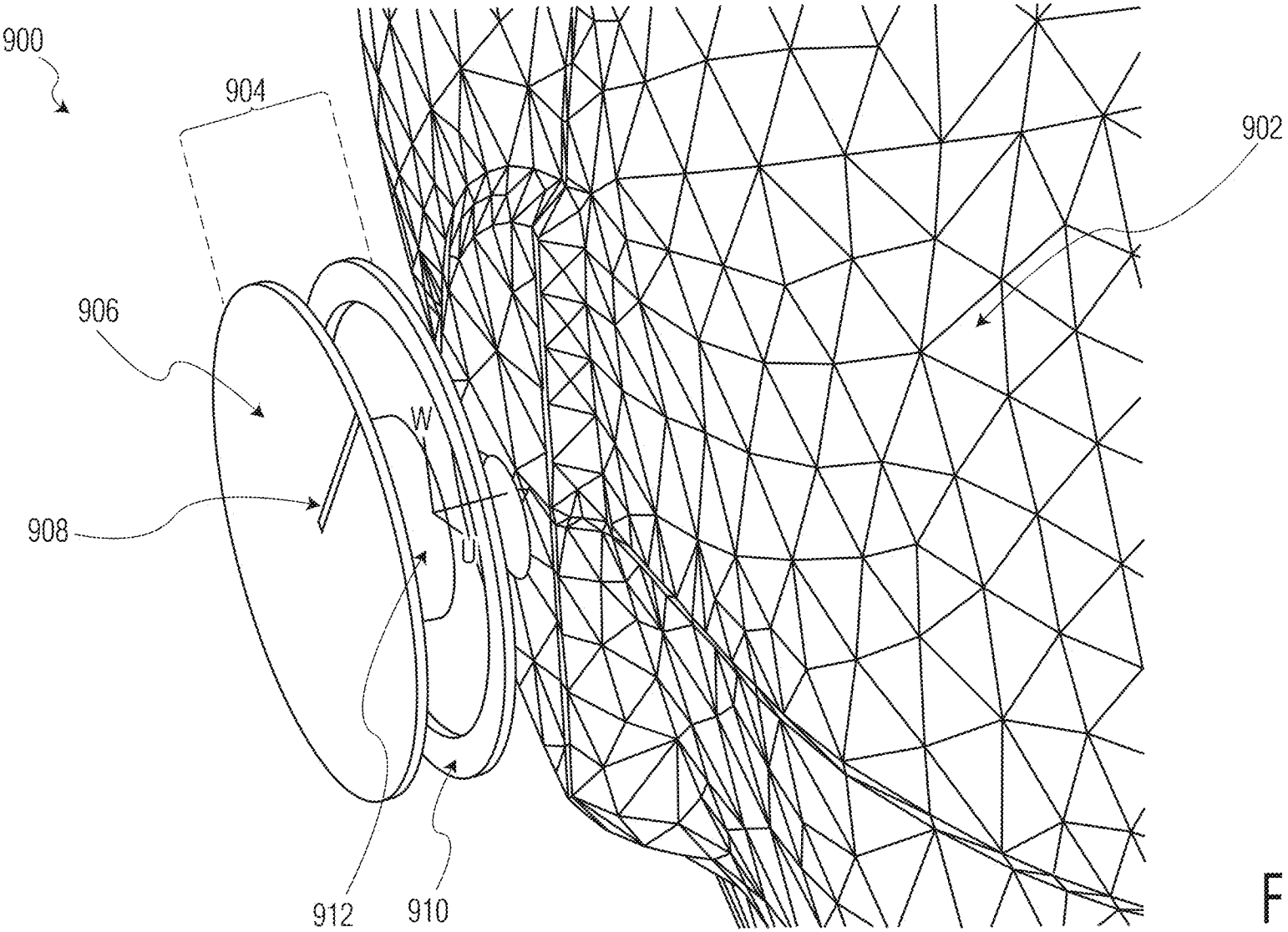
FIG. 9A is a fifth example conductive plane antenna.

FIG. 9A is a fifth example conductive plane antenna 900. The fifth example conductive plane antenna 900 shows a user 902 wearing a headphone 904. The headphone 904 includes a conductive plane 906 having an open cavity 908, and a conducting (e.g. metal) reflector 910 (e.g. a conductive ring). In this example embodiment, the reflector 910 is part of (e.g. an outer rim of) a loudspeaker structure having a center electromagnetic coil 912.

The reflector 910 is on one side of the conductive plane 906. The reflector 910 is configured to redirects any energy radiated from the conductive plane 906 toward the user 902 back away from the user 902 so as to enhance radiation away from the user's 902 head and toward any other wireless device with which communication is desired.

In one example embodiment, the resultant increase in antenna 900 gain can be roughly 6 dB, which about doubles the antenna's 900 communication range.

In some example embodiments, the reflector 910 also includes a non-conductive cavity, which is aligned with the open cavity 908 in the conductive plane 906. For example, if the spacing between the reflector 910 and the conductive plane 906 with slot 908 is sufficiently large, there does not need to be a non-conductive cavity in 910. However, if 910 and 906 are close to each other, a 910 reflector with a cavity can yield a better antenna gain pattern.

Antenna 900 input impedance minimally affected so that impedance matching with various electronic components/circuits is still excellent.

Figure 9B:
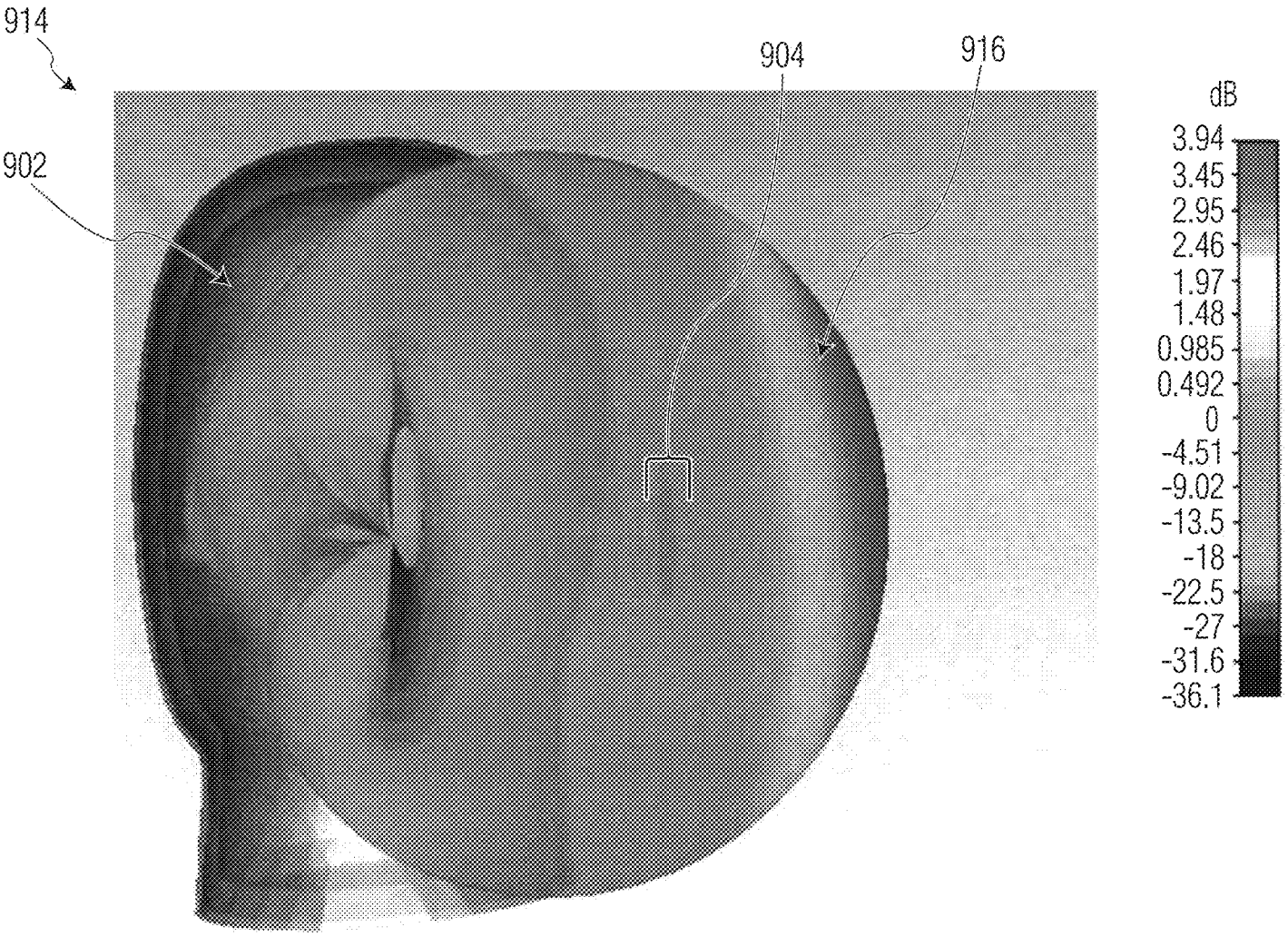
FIG. 9B is an example simulated radiation pattern for the fifth example conductive plane antenna of FIG. 9A.

FIG. 9B is an example simulated 3 dimensional radiation pattern 914 for the fifth example conductive plane antenna 900 of FIG. 9A. Shown is the user 902, the headphone 904, and an example antenna gain 916.

It will be readily understood that the components of the embodiments as generally described herein and illustrated in the appended Figures could be arranged and designed in a wide variety of different configurations. Thus, the detailed description of various embodiments, as represented in the Figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment," "an embodiment," or similar language means that a particular feature, structure, or characteristic described in connection with the indicated embodiment is included in at least one embodiment of the present invention. Thus, the phrases "in one embodiment," "in an embodiment," and similar language throughout this specification may, but do not necessarily, all refer to the same embodiment.

What is claimed is:

1. A conductive plane antenna, comprising:

a non-conductive substrate;

a conductive plane coupled to the non-conductive substrate;

wherein the conductive plane includes an open cavity;

wherein the cavity includes a closed end and an open end;

a first feed point coupled to the conductive plane and configured to pass a first polarity of a set of electromagnetic signals; and a second feed point coupled to the conductive plane and configured to pass a second polarity of the set of electromagnetic signals;

wherein the conductive plane is configured to generate a first antenna gain pattern in response to the first and second polarity signals;

wherein the cavity is configured to generate a second antenna gain pattern in response to the first and second polarity signals;

wherein a magnitude of the first antenna gain pattern is greater than a magnitude of the second antenna gain pattern; and wherein the open cavity includes a depth having a physical or electrical length at least one-quarter wavelength of a lowest in-band frequency in the set of electromagnetic signals.

2. The antenna of claim 1:

wherein the cavity further includes a first edge and a second edge; and wherein the cavity is positioned within the conductive plane such that a first current distribution on the first edge of the cavity is opposite to a second current distribution on the second edge of the cavity.

3. The antenna of claim 2:

wherein a polarity of the first current distribution at the first edge is opposite to a polarity of the second current distribution on the second edge of the cavity.

4. The antenna of claim 3:

wherein a magnitude of the first current distribution at the first edge is substantially equal to a magnitude of the second current distribution on the second edge of the cavity.

5. The antenna of claim 1:

wherein the cavity further includes a first edge and a second edge; and wherein the cavity is positioned within the conductive plane such that a first current distribution on the first edge of the cavity substantially cancels out a second current distribution on the second edge of the cavity.

6. The antenna of claim 1:

wherein the first and second feed points are located closer to the closed end of the cavity than the open end.

7. The antenna of claim 1:

wherein the conductive plane is connected to at least one of: a ground potential, a power supply potential, or an intermediate circuit potential.

8. The antenna of claim 1:

wherein the conductive plane includes an outer edge having a physical or electrical length of at least one-half wavelength of a lowest in-band frequency in the set of electromagnetic signals.

9. The antenna of claim 1:

wherein, excluding the open cavity, the conductive plane includes an outer edge which is continuously curved.

10. The antenna of claim 1:

wherein the conductive plane includes an outer edge; and wherein the outer edge is defined by an envelope that is either circular or oval in shape.

11. The antenna of claim 1:

wherein the closed end of the open cavity is located proximate to a geometrical center of the conductive plane.

12. The antenna of claim 1:

further comprising a conducting reflector on one side of the conductive plane.

13. The antenna of claim 12:

wherein the conducting reflector is a loudspeaker.

14. The antenna of claim 12:

wherein the reflector includes a non-conductive cavity aligned with the open cavity in the conductive plane.

15. The antenna of claim 1:

further comprising a second conductive plane;

wherein the first conductive plane is coupled to the second conductive plane with vias.

16. The antenna of claim 1:

further comprising a set of electrical circuits or components on a same side of the substrate as the conductive plane; and wherein the conductive plane surrounds the electrical circuits or components.

17. A conductive plane antenna, comprising:

a non-conductive substrate;

a conductive plane coupled to the non-conductive substrate;

wherein the conductive plane includes an open cavity;

wherein the cavity includes a closed end and an open end;

a first feed point coupled to the conductive plane and configured to pass a first polarity of a set of electromagnetic signals; and a second feed point coupled to the conductive plane and configured to pass a second polarity of the set of electromagnetic signals;

wherein the conductive plane is configured to generate a first antenna gain pattern in response to the first and second polarity signals;

wherein the cavity is configured to generate a second antenna gain pattern in response to the first and second polarity signals;

wherein a magnitude of the first antenna gain pattern is greater than a magnitude of the second antenna gain pattern;

wherein the cavity further includes a first edge and a second edge; and wherein the cavity is positioned within the conductive plane such that a first current distribution on the first edge of the cavity is opposite to a second current distribution on the second edge of the cavity.

18. The antenna of claim 17:

wherein the antenna is embedded in a wearable device; and wherein the wearable device is at least one of: a wireless gaming headphone, a wireless headset, a smart helmet, or smart/VR goggles.

19. A conductive plane antenna, comprising:

a non-conductive substrate;

a conductive plane coupled to the non-conductive substrate;

wherein the conductive plane includes an open cavity;

wherein the cavity includes a closed end and an open end;

a first feed point coupled to the conductive plane and configured to pass a first polarity of a set of electromagnetic signals; and a second feed point coupled to the conductive plane and configured to pass a second polarity of the set of electromagnetic signals;

wherein the conductive plane is configured to generate a first antenna gain pattern in response to the first and second polarity signals;

wherein the cavity is configured to generate a second antenna gain pattern in response to the first and second polarity signals;

wherein a magnitude of the first antenna gain pattern is greater than a magnitude of the second antenna gain pattern;

further comprising a set of electrical circuits or components on a same side of the substrate as the conductive plane; and wherein the conductive plane surrounds the electrical circuits or components.

20. A conductive plane antenna, comprising:

a non-conductive substrate;

a conductive plane coupled to the non-conductive substrate;

wherein the conductive plane includes an open cavity;

wherein the cavity includes a closed end and an open end;

a first feed point coupled to the conductive plane and configured to pass a first polarity of a set of electromagnetic signals; and a second feed point coupled to the conductive plane and configured to pass a second polarity of the set of electromagnetic signals;

wherein the conductive plane is configured to generate a first antenna gain pattern in response to the first and second polarity signals;

wherein the cavity is configured to generate a second antenna gain pattern in response to the first and second polarity signals; and wherein a magnitude of the first antenna gain pattern is greater than a magnitude of the second antenna gain pattern;

further comprising a conducting reflector on one side of the conductive plane;

wherein the reflector includes a non-conductive cavity aligned with the open cavity in the conductive plane.

* * * * *